US006022255A

United States Patent [19]

Lukanovich

[11] Patent Number: 6,022,255

[45] Date of Patent: Feb. 8, 2000

[54] UNIVERSAL KAYAK/CANOE PADDLE

[76] Inventor: Louis Lukanovich, 1119 Notre Dame Nord, Montfort, Canada, J0T 1Y0

[21] Appl. No.: 09/378,837

[22] Filed: Aug. 23, 1999

[51] Int. Cl.[7] ..... B63H 16/04

[52] U.S. Cl. ..... 440/101

[58] Field of Search ..... 416/70 R, 69; 440/101, 102

[56] References Cited

U.S. PATENT DOCUMENTS

| | | | |
|---|---|---|---|
| 3,970,032 | 7/1976 | Phillips | 440/101 |
| 4,820,216 | 4/1989 | Masters | 440/101 |
| 4,926,772 | 5/1990 | Bright | 114/39.2 |

*Primary Examiner*—Ed Swinehart
*Attorney, Agent, or Firm*—Eric Fincham

[57] ABSTRACT

There is provided a kit for forming an adjustable paddle which, in kayak embodiment, includes a first paddle end and a second paddle end each having a blade an a shaft, an intermediate connecting shaft telescopically engaging the shafts of the paddle ends, with the intermediate connecting shaft having indicating means for indicating the center of gravity and distance indicating means, along with means for fixedly securing the shaft and second shaft through the intermediate connecting shaft. The arrangement ensures that a properly balanced paddle is obtained. An optional handle may be provided for converting the kayak paddle to one or more canoe paddles.

11 Claims, 2 Drawing Sheets

UNIVERSAL KAYAK/CANOE PADDLE

The present invention relates to a paddle and more particularly, relates to a multipurpose adjustable paddle suitable for kayaking.

BACKGROUND OF THE INVENTION

Kayaking has become increasingly popular in the past few years. There are a number of different types of kayaking and the boats and paddles associated therewith are designed for the particular type. Thus, there are both calm water kayaks and white water kayaks along with sea or ocean kayaking.

The kayaker, after some experience, normally likes a paddle which can be customized to their particular requirements. However, doing so is relatively expensive and leaves the paddle unsuitable for other people to use.

It has been proposed in the art to manufacture the paddle of two pieces which are secured together; however, much of the structural integrity of a one piece structure has been lost. This is important, particularly in white water kayaking. Thus, an extra paddle is not carried in a white water kayak and if the construction is not capable of surviving the rigorous encounters, there may be paddle failure with potentially dangerous results.

As aforementioned, an adjustable kayak paddle would also be desirable in that it could reduce the expenses. Such an instance would be the case of a family with a single kayak but with two or more people using the kayak—for example, a parent and a child. In such an instance, the paddle suitable for the parent would certainly not be suitable for the child. A further instance where adjustability of the length would be preferable is in the instance where kayaks and paddles are rented. In such an instance, the lessor must have an inventory of various size paddles in order to meet the requirements of the different customers renting the equipment.

A further requirement for a kayak paddle is the adjustability of the relative orientation of the two blades and the angles. In a paddle which is controlled by the right hand, the wrist of the right hand is utilized to rotate the paddle 90 degrees on alternate strokes so that the face of the paddle properly enters the water. The shaft of the paddle is held loosely in the left hand while rotated by the wrist of the right hand on the left hand stroke. In a left hand controlled paddle, the opposite is true. The left hand grips the paddle and the wrist of the left hand rotates the paddle 90 degrees which is held loosely in the right hand. In some applications, it is desirable to use a paddle which is made in either a right hand or a left hand control and both a feathered and non feathered configuration. A generally universal position is provided by a kayak paddle having a non feathered blade configuration.

Normally, kayak paddles have been sold in a fixed length and with blade angles relative to each other of 90 degrees. However, blade angles have also been sold between 50 degrees and 90 degrees to allow the kayaker to reach a physical compromise which reduces windage of the top blade as well as to make the kayak easier to Eskimo roll. Inherently, to make a stock of a wide range of customized paddles is expensive and in many instances impractical.

Although there have been proposals in the prior art for kayak paddles which are adjustable in length and/or pitch, they have not become widely accepted either due to design which does not provide the required durability and/or lack of balance in the paddle after adjustment.

SUMMARY OF THE INVENTION

It is therefore an object of the present invention to provide a paddle which may be adjusted in both length and pitch.

It is a further object of the present invention to provide a two bladed paddle which can be adjusted in both length and pitch while maintaining a balance for the paddle.

It is a further object of the present invention to provide a two bladed paddle which has a wide range of adjustments without using tools.

According to one aspect of the present invention, there is provided an adjustable paddle suitable for use with a kayak or like water craft, the paddle comprising a first paddle end, the first paddle end having a first blade and a first shaft extending from the first blade, a second paddle end, the second paddle end having a second blade and a second shaft extending from the second blade, an intermediate connecting shaft, the intermediate connecting shaft telescopically engaging each of the first and second shafts of the first and second paddle ends, the intermediate connecting shaft having a center of gravity indicating means thereon marking a center of gravity thereof, and a plurality of distance indicating means indicating fixed distances from said center of gravity; and locking means for fixedly securing the first shaft and the second shaft to the intermediate connecting shaft.

In a further aspect of the invention there is provided a kit for forming an adjustable paddle, the kit comprising a first paddle end having a first blade and a first shaft extending from the first blade, a second paddle end having a second blade and a second shaft extending from the second blade, an intermediate connecting shaft; the intermediate connecting shaft being sized to telescopically engage each of the first and second shafts of the first and second paddle ends, the intermediate connecting shaft having a center of gravity indicating means thereon marking a center of gravity thereof, and a plurality of distance indicating means indicating fixed distances from the center of gravity; and locking means for fixedly securing the first shaft and the second shaft to the intermediate connecting shaft.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
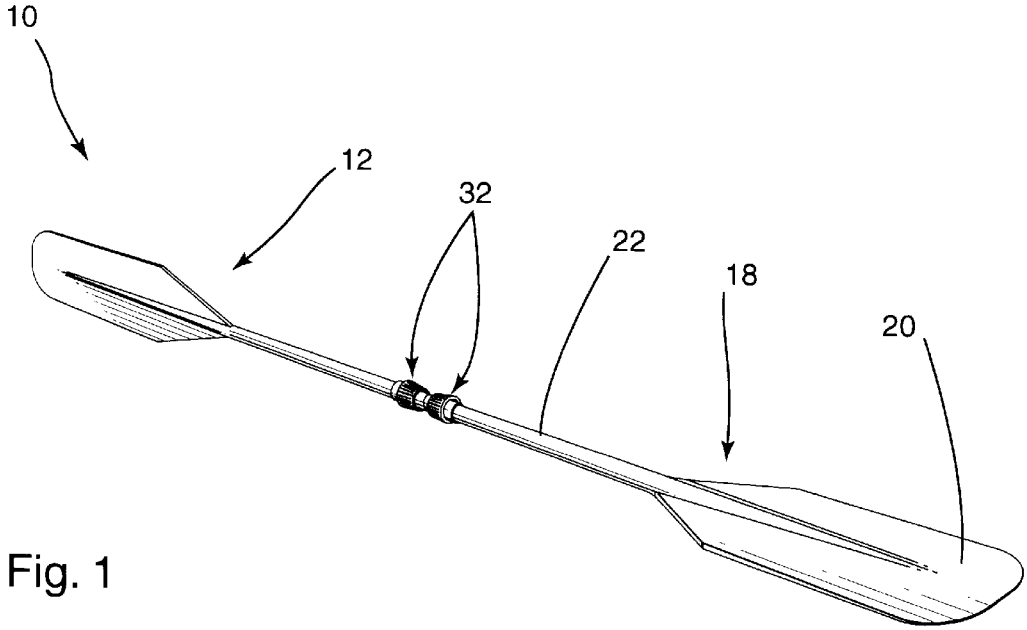
FIG. 1 is a perspective view of a kayak paddle according to an embodiment of the present invention.

Referring to the drawings in greater detail and by reference characters thereto, there is illustrated in FIG. 1 a kayak paddle generally designated by reference numeral 10 and which kayak paddle 10 is formed from a kit according to the present invention.

Kayak paddle 10 has a first paddle end 12 and a second paddle end 18. First paddle end 12 has a conventional blade 14 with a shaft 16 extending outwardly therefrom. Blade 14 and shaft 16 may be formed as a single piece by molding or alternatively, may be separate components suitably secured together. Similarly, second paddle end 18 has a blade 20 and shaft 22 extending therefrom.

Figure 2:
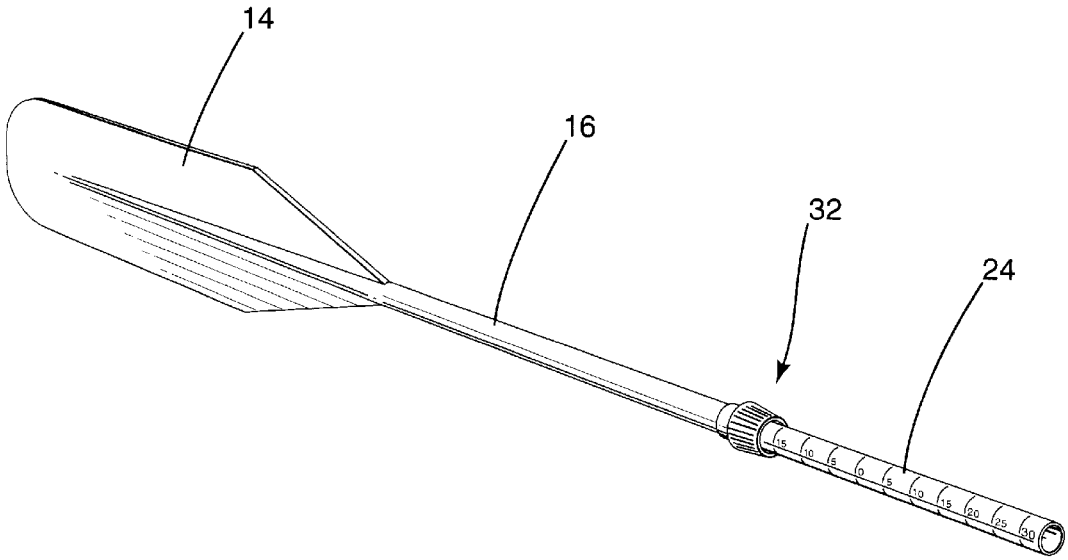
FIG. 2 is a perspective view of one paddle end and the intermediate connecting shaft for connecting paddle ends together.

Paddle ends 12 and 18 are connected together through an intermediate connecting shaft 24 as shown in FIG. 2. Intermediate connecting shaft 24 has a longitudinally extending indicating line 26 and a plurality of transverse distance indicating lines 28 shown in FIG. 3. One of transverse indicating lines 28 indicates the zero point or center of gravity 29 and a plurality of indicia 30 may be provided to indicate fixed distances from the center of gravity—in the illustrated embodiment, units of 5 cm are illustrated.

For securing first paddle end 12, second paddle end 18 and intermediate connecting shaft 24 together, there are provided locking means generally designated by reference numeral 32 and which locking means comprise compression fittings.

Figure 3:
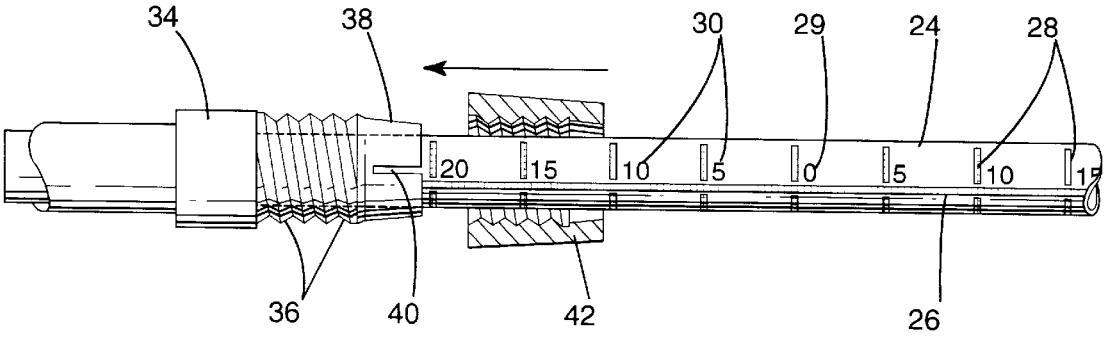
FIG. 3 is a side elevational view, partially in section, showing the connection of the intermediate connecting shaft and paddle end.

As best seen in FIG. 3, each locking means 32 includes a collet 34 on the shaft of the paddle ends. Collet 34 has threads 36 formed thereon and a flange portion 38 having slots 40 therein. A locking nut 42 is designed to screw threadably engage threads 36 and increasingly exert a compressive force on flange portion 38 to secure intermediate connecting shaft 24 at a desired position.

Intermediate connecting shaft 24 is sized to telescopically fit within shafts 16 and 22. The overall length of the paddle may be adjusted by moving each paddle end a desired number of increments from the center of gravity with each paddle end being equally removed therefrom to maintain a balanced paddle. The feather can also be adjusted by rotational movement and to this end, transverse indicating lines 28 may extend for a certain distance—for example, each may extend outwardly from longitudinal indicating line 26 a distance through 90 degrees. Slot 40 can be used as a frame of reference for adjusting the paddle ends with respect to each other as shown in FIG. 1.

Figure 4:
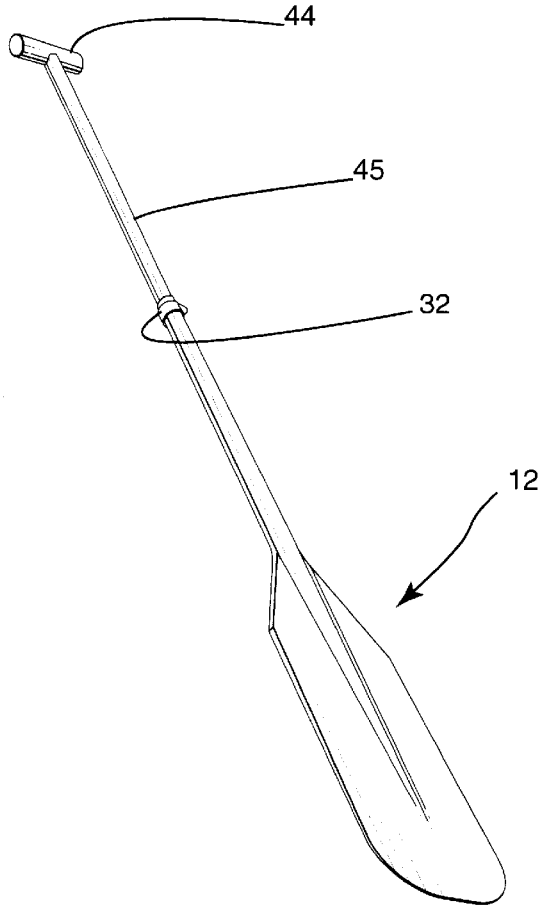
FIG. 4 is a perspective view of a canoe paddle formed from a kit according to the present invention.

The kit can also be employed to provide a canoe paddle and such an embodiment is illustrated in FIG. 4. In this embodiment, only a first paddle end 12 is utilized with a T-shaped handle 44 which has a shaft 45 secured by a compression fitting 32. As is the case with the kayak paddle 10, the length may be adjusted as desired.

The compression fittings are such that the first and second shafts may be adjusted and then secured manually in the desired position. There is no play in the shaft when tightened yet they are easily loosened by hand without requiring the use of any tools. The handle sections of the paddle may be covered by Teflon™ sleeves.

The length can vary although conveniently, the blade sections may have a length of between 80 to 100 centimeters with the intermediate connecting shaft being between 60 and 80 centimeters in length. Typically, this would provide for adjustment of at least a range of 50 centimeters.

The arrangement permits one kit to serve a group of people. The paddles are easy to transport, store and assemble. The paddles permit one to determine the optimum length and feather to suit individual needs and preferences and they can be changed as required depending on water, wind, skill, boat, etc.

It will be understood that the above described embodiments are for purposes of illustration only and that changes and modifications may be made thereto without departing from the spirit and scope of the invention.

I claim:

1. An adjustable paddle suitable for use with a kayak or like water craft, said paddle comprising:

a first paddle end, said first paddle end having a first blade and a first shaft extending from said first blade;

a second paddle end, said second paddle end having a second blade and a second shaft extending from said second blade;

an intermediate connecting shaft, said intermediate connecting shaft telescopically engaging each of said first and second shafts of said first and second paddle ends, said intermediate connecting shaft having a center of gravity indicating means thereon marking a center of gravity thereof, and a plurality of distance indicating means indicating fixed distances from said center of gravity; and locking means for fixedly securing said first shaft and said second shaft to said intermediate connecting shaft.

2. The paddle of claim 1 wherein said intermediate connecting shaft telescopically fits within said first and second shafts of said first and second paddle ends.

3. The paddle of claim 1 wherein said intermediate connecting shaft and said first and second shafts have angle indicating means for indicating an angle of the paddle with respect to said intermediate connecting shaft.

4. The paddle of claim 2 wherein said indicating means comprise a plurality of transversely extending markings on said intermediate connecting shaft.

5. The paddle of claim 2 wherein said locking means comprise a pair of compression fittings.

6. A kit for forming an adjustable paddle, said kit comprising:

a first paddle end having a first blade and a first shaft extending from said first blade;

a second paddle end having a second blade and a second shaft extending from said second blade;

an intermediate connecting shaft; said intermediate connecting shaft being sized to telescopically engage each of said first and second shafts of said first and second paddle ends, said intermediate connecting shaft having a center of gravity indicating means thereon marking a center of gravity thereof, and a plurality of distance indicating means indicating fixed distances from said center of gravity; and locking means for fixedly securing said first shaft and said second shaft to said intermediate connecting shaft.

7. The kit of claim 6 further including a handle member sized to fit on an end of said intermediate connecting shaft, and second locking means for fixedly securing said handle member to said intermediate connecting shaft.

8. The kit of claim 7 wherein said first and second shafts extending from said first and second blades respectively each have a hollow end portion, said intermediate connecting shaft being sized to telescopically fit within said hollow portion of each of said first and second shafts.

9. The kit of claim 6 wherein said intermediate connecting shaft and said first and second shafts have angle indicating means for indicating an angle of the paddle with respect to said intermediate connecting shaft.

10. The kit of claim 6 wherein said indicating means comprises a plurality of transversely extending marking on said intermediate connecting shaft.

11. The kit of claim 6 wherein said locking means comprises a pair of compression fittings.

* * * * *